US006227844B1

(12) United States Patent
Mifune et al.

(10) Patent No.: US 6,227,844 B1
(45) **Date of Patent: *May 8, 2001**

(54) COMBUSTOR STRUCTURE FOR IGNITERS

(75) Inventors: Hideo Mifune; Yasuaki Nakamura; Masato Seki; Takashi Tsukamoto, all of Shizuoka-ken (JP)

(73) Assignee: Tokai Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/269,621

(22) PCT Filed: Jul. 8, 1998

(86) PCT No.: PCT/JP98/03060

§ 371 Date: Mar. 30, 1999

§ 102(e) Date: Mar. 30, 1999

(87) PCT Pub. No.: WO99/06769

PCT Pub. Date: Feb. 11, 1999

(30) Foreign Application Priority Data

Aug. 1, 1997 (JP) ..... 9-207603

(51) Int. Cl.[7] ..... F23D 3/18

(52) U.S. Cl. ..... 431/325; 431/320; 431/149

(58) Field of Search ..... 431/298, 320, 431/325, 276, 277, 149, 152

(56) References Cited

U.S. PATENT DOCUMENTS

| | | | | |
|---|---|---|---|---|
| 2,512,767 | * | 6/1950 | Campbell | 431/276 |
| 2,556,853 | * | 6/1951 | Shanks | 431/277 |
| 2,557,825 | * | 6/1951 | Hotze | 431/149 |
| 2,820,511 | * | 1/1958 | McCutchen | 431/325 |
| 3,652,197 | * | 3/1972 | Tokarz | 431/326 |
| 3,790,332 | * | 2/1974 | Woollard | 431/126 |
| 4,126,408 | * | 11/1978 | Cox | 431/146 |
| 4,131,414 | * | 12/1978 | Curtis | 431/104 |
| 4,134,718 | * | 1/1979 | Kayfetz et al. | 431/125 |
| 4,269,591 | * | 5/1981 | Knoll | 431/312 |
| 4,511,952 | * | 4/1985 | Vanbragt | 431/344 |
| 4,518,347 | * | 5/1985 | Sonetaka et al. | 431/325 |
| 4,569,656 | * | 2/1986 | Shimizu et al. | 431/298 |
| 4,689,727 | * | 8/1987 | Perkins | 431/320 |
| 4,725,225 | * | 2/1988 | Gravitt | 431/298 |
| 4,735,568 | * | 4/1988 | Izumisawa et al. | 431/325 |
| 4,872,831 | * | 10/1989 | Fujimoto et al. | 431/304 |
| 4,878,832 | * | 11/1989 | Lynch | 431/126 |
| 4,895,511 | * | 1/1990 | Schmid | 431/126 |
| 5,567,146 | * | 10/1996 | Blankenship et al. | 431/320 |

OTHER PUBLICATIONS

Microfilm of the specification and drawing annexed to the request of Japanese Utility Model Application No. 114547/1990 (Laid–open No. 73703/1992) (Silver K.K.), Jun. 29, 1992 (29. 06. 1992), Full text (Family: none).

Microfilm of the specification and drawings annexed to the request of Japanese Utility Model Application No. 54037/1989 (Laid–open No. 147657/1990) (Yukio Nishida), Dec. 14, 1990 (14. 12. 90 ), Full text (Family: none).

* cited by examiner

*Primary Examiner*—Ira S. Lazarus
*Assistant Examiner*—David Lee
(74) *Attorney, Agent, or Firm*—BakerBotts, LLP

(57) ABSTRACT

In a structure of a burning portion of an alcohol-fueled ignitor provided with a wick for drawing up fuel alcohol in a fuel reservoir by capillarity from one end portion thereof to the other end portion and burning the fuel alcohol at the other end portion, the wick is formed of glass fibers and said the other end portion of the wick at which the fuel alcohol is burnt is exposed in a surface area of 30 $mm^2$ to 170 $mm^2$.

7 Claims, 19 Drawing Sheets

COMBUSTOR STRUCTURE FOR IGNITERS

FIELD OF THE INVENTION

This invention relates to a structure of a burning portion at the tip of a wick of an ignitor such as a cigarette lighter in which fuel alcohol contained in a fuel reservoir is drawn up through the wick by capillarity and is burnt at the tip of the wick.

More particularly, this invention relates to a form of a burning portion, of an ignitor such as a cigarette lighter using fuel liquid containing alcohol as a main component, suitable for obtaining optimal burning.

BACKGROUND OF THE INVENTION

As fuel for an ignitor such as a cigarette lighter, there is generally used fuel alcohol such as ethyl alcohol, fuel benzine such as petroleum benzine, or liquefied gas fuel such as butane gas, propane gas or the like.

Performance, convenience of handling and design properties of ignitors differ depending on the kind of fuel used.

For example, in the case of fuel benzine which is a mixture of petroleum benzine series hydrocarbons different in boiling point, benzine components lower in boiling point are mainly volatilized at the beginning of use and the volatile components change to those of higher boiling points. Accordingly, the composition of the fuel remaining in the ignitor changes with the burning time, which causes change in the flame length. The same is the case with gasoline. Further since benzine and gasoline are high in volatility, a closed structure for suppressing volatilization of fuel liquid from the fuel storage portion and/or the wick is required in an ignitor where benzine or gasoline is used as the fuel liquid. When closure of the closed structure is insufficient, the fuel liquid is soon lost and the fuel liquid must be frequently replenished. Further some people are not fond of the peculiar odor of benzine and gasoline.

In the case of liquefied gas fuel, the pressure of gas is high in the operating temperature range of the ignitor and accordingly the fuel reservoir must be pressure-resistant. Further, the flame length changes with change in the gas pressure which logarithmically largely changes with change in the temperature, and large fluctuation in the flame length with change in the temperature has been a problem with a gas ignitor. In order to overcome this problem, the fuel supply system of the ignitor must be provided with a special temperature correction means, which complicates the structure of the ignitor and adds to the cost.

The alcohol fuel mainly comprises monovalent lower alcohol such as ethyl alcohol, methyl alcohol, propyl alcohol or the like and is liquid at normal temperatures and is relatively low in vapor pressure. Accordingly, an alcohol-fueled ignitor need not be pressure-resistant in its fuel reservoir, and the fuel storage portion and/or the wick have only to be closed to such an extent that volatilization of the alcohol fuel can be suppressed. Accordingly, the alcohol-fueled ignitor can be simpler in structure and can be manufactured at lower cost.

In the alcohol-fueled ignitor, the alcohol fuel is supplied from the fuel reservoir to the burning portion through a wick which is of an open cell cellular material or of a bundle of thin fibers. The alcohol fuel is drawn up from the lower end portion of the wick and supplied to the upper end portion of the wick through the open cell or the fine spaces between the fibers by capillarity.

More specifically, the wick is formed by twisting fibers, by bundling glass fibers, or by wrapping a bundle of glass fibers by cotton yarns and fixing the cotton yarns to the glass fiber bundle by winding thin metal wire around the cotton yarns.

In an ignitor in accordance with a prior art in which fuel liquid containing therein alcohol as a main component thereof is used, the structure of the wick should be as simple as possible so that the quality of the wick is uniform and the wicks can be manufactured at low cost since the structure of the wick is related to the burning properties of the ignitor. For this purpose, it is preferred that the wick is formed of glass fibers or ceramic fibers.

In an ignitor using such a wick, an initial flame length just after the fuel is ignited, change of the flame length, the maximum flame length and the like vary depending upon the material, dimensions and shape of the wick, and accordingly the wick should be arranged to meet desired properties of the ignitor.

That is, in the alcohol-fueled ignitor such as a cigarette lighter, fuel on the surface of the wick starts burning with flame upon ignition thereof. The flame length at this time is taken as an initial flame length.

Then the wick is heated by the burning and the amount of fuel volatilizing from the surface of the wick increases, whereby the flame length increases. However increase in temperature at the surface of the wick gets equilibrated and stops as the burning continues, and increase in the flame length is saturated and the flame length reaches a saturated flame length. As fuel on the surface of the wick burns and consumes, fuel inside the wick is dispersed toward the surface of the wick and fuel in the fuel reservoir is drawn up through the lower end portion of the wick.

When consumption of fuel at the surface of the wick balances supply of fuel from the inside of the wick and supply of fuel from the fuel reservoir, burning continues in the equilibrated state and the flame length is stabilized. To the contrast, when fuel consumption at the surface of the wick exceeds fuel supply from the inside of the wick, the flame length becomes shorter than the initial flame length and gets equilibrated at a level according to the fuel supply or the flame is quenched.

In view of the foregoing observations and description, the primary object of the present invention is to provide a structure of a burning portion of an alcohol-fueled ignitor which is suitable for obtaining optimal burning.

In the case of a cigarette lighter, preferably the flame length is initially at least about 20 mm and increases to about 25 mm in 10 seconds or so. Further it is preferred that the saturated flame length, that is, the flame length when the wick is heated to an equilibrium temperature, be about 60 mm to 70 mm (about 50 mm to 70 mm according to the purpose of the ignitor) at most. In order to meet these requirements, the wick should have the capability of drawing up fuel liquid and retaining the same and should be heat-resistant. Further, the wick should be of such a form that the aforesaid burning conditions can be realized.

SUMMARY OF THE INVENTION

In accordance with one aspect of the present invention, there is provided a structure of the burning portion of an alcohol-fueled ignitor provided with a wick for drawing up fuel alcohol in a fuel reservoir by capillarity from one end portion thereof to the other end portion and burning the fuel alcohol at the other end portion wherein the improvement comprises that the wick is formed of glass fibers and said the other end portion of the wick at which the fuel alcohol is burnt is exposed in a surface area of 30 $mm^2$ to 170 $mm^2$.

In the case where the ignitor is a cigarette lighter, it is preferred that said the other end portion of the wick is exposed in a surface area of 30 $mm^2$ to 100 $mm^2$.

In accordance with another aspect of the present invention, there is provided a structure of the burning portion of an alcohol-fueled ignitor provided with a wick for drawing up fuel alcohol in a fuel reservoir by capillarity from one end portion thereof to the other end portion and burning the fuel alcohol at the other end portion, wherein the improvement comprises that the wick is formed of ceramic fibers and said the other end portion of the wick at which the fuel alcohol is burnt is exposed in a surface area of 40 $mm^2$ to 170 $mm^2$.

In the case where the ignitor is a cigarette lighter, it is preferred that said the other end portion of the wick is exposed in a surface area of 40 $mm^2$ to 100 $mm^2$.

With the structure of the burning portion of the ignitor, the burning properties can be held in an optimal state where the flame length is initially about 20 mm, is increased to about 25 mm in about 10 seconds, and is kept about 60 mm in the saturated state, by virtue of the fact that the burning end portion of the wick at which the fuel alcohol is burnt is exposed in a surface area of 30 $mm^2$ to 170 $mm^2$ (30 $mm^2$ to 100 $mm^2$ in the case of a cigarette lighter) when the wick is of glass fibers or that the burning end portion of the wick at which the fuel alcohol is burnt is exposed in a surface area of 40 $mm^2$ to 170 $mm^2$ (40 $mm^2$ to 100 $mm^2$ in the case of a cigarette lighter) when the wick is of ceramic fibers.

Especially when the ignitor is a cigarette lighter, it is preferred that the overall size of the cigarette lighter be as small as possible, and accordingly dimensions and the shape of the structure of the burning end portion are limited. Therefore, by defining the circumference, the outer diameter and/or the amount of projection of the burning end portion of the wick so that the surface area of the burning end portion falls within the aforesaid range, the cigarette lighter can be miniaturized and manufactured at low cost while obtaining optimal burning properties.

It is preferred that the circumference of the burning end portion of the wick be in the range of 6 mm to 20 mm, the outer diameter of the burning end portion of the wick be in the range of 2 mm to 5 mm, and the amount of projection of the burning end portion of the wick from a support be in the range of 3.0 mm to 7.0 mm. With this arrangement, a burning portion of an ignitor which is suitable for practical use can be obtained.

In accordance with still another aspect of the present invention, there is provided a structure of the burning portion of an alcohol-fueled ignitor provided with a wick for drawing up fuel alcohol in a fuel reservoir by capillarity from one end portion thereof to the other end portion and burning the fuel alcohol at the other end portion wherein the improvement comprises that said the other end portion of the wick at which the fuel alcohol is burnt is exposed in a surface area which is determined so that the flame length is not shorter than a predetermined value just after ignition, is increased to a predetermined value in a predetermined time after ignition and is held at a saturated flame length not larger than a predetermined flame length in an equilibrated state. With this arrangement, an ignitor having excellent burning properties can be easily obtained.

The wick employed in the present invention may be formed of a bundle of glass fibers, a material obtained by forming a mixture of ceramic fibers and a small amount of binder into a plate about 3 mm to 5 mm thick and drying it, or a material obtained by adding a small amount of binder and water to ceramic fibers, extruding the resulting viscous fluid into a round or rectangular bar by an extruder, and drying and solidifying the bar. Such a material is processed into a wick which can be used in an ignitor to draw up fuel alcohol in a fuel reservoir by capillarity from one end portion thereof to the other end portion and burning the fuel alcohol at the other end portion. The surface area of the exposed burning end portion of the wick is determined so that the flame length is not shorter than a predetermined value just after ignition, is increased to a predetermined value in a predetermined time after ignition and is held at a saturated flame length not larger than a predetermined flame length in an equilibrated state.

Said one end portion (wicking end portion) and said the other end portion (burning end portion) of the wick may be either of the same material or of different materials.

As the fuel alcohol, for instance, a mixture of monovalent lower alcohol such as ethyl alcohol, methyl alcohol, propyl alcohol or the like with a saturated hydrocarbon such as hexane, heptane or the like for coloring the flame may be employed.

PREFERRED EMBODIMENT OF THE INVENTION

Embodiments of the present invention will be described with reference to the drawings, hereinbelow.

First Embodiment

Figure 1:
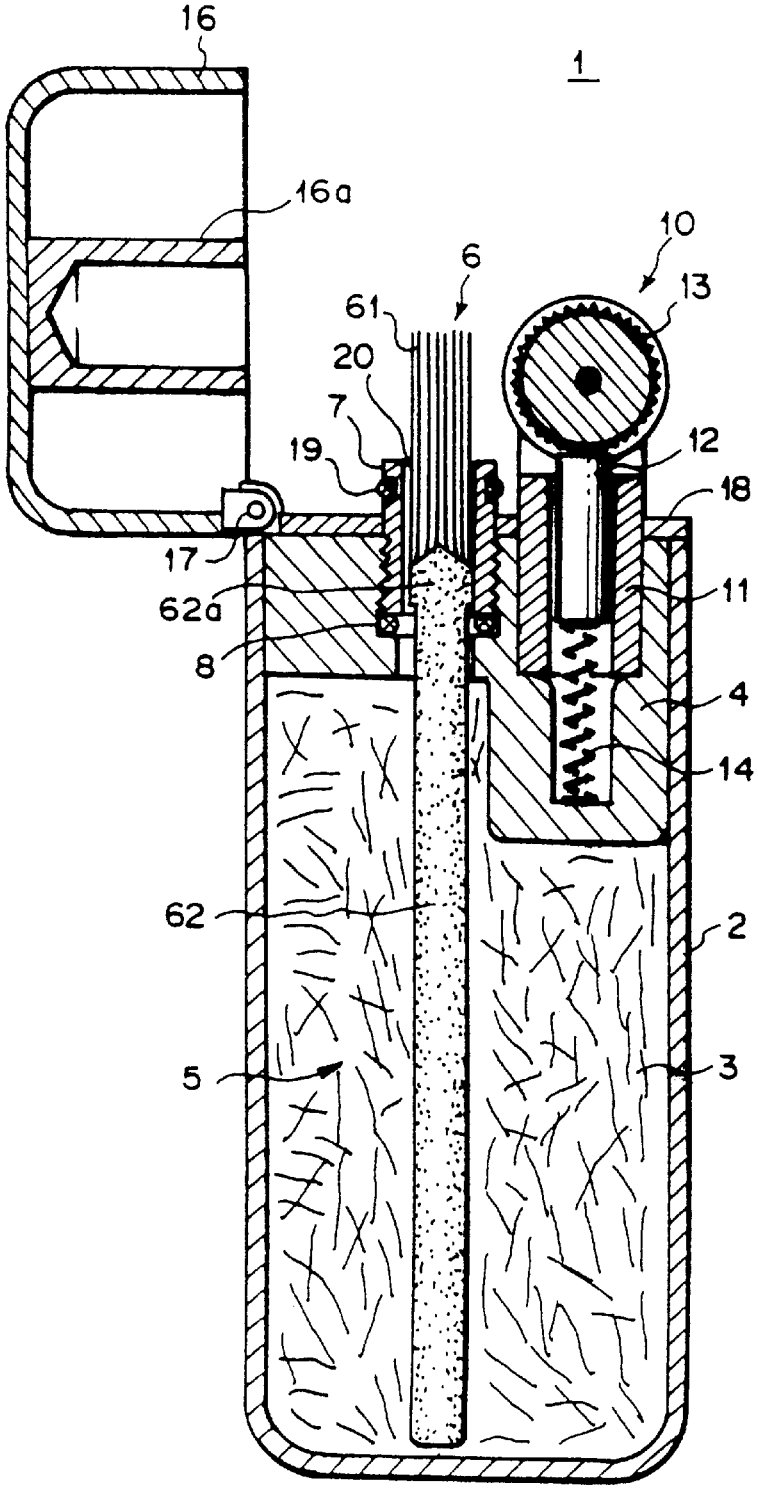
FIG. 1 is a schematic cross-sectional view of a cigarette lighter in accordance with a first embodiment of the present invention.

FIG. 1 shows in cross-section a disposable cigarette lighter in accordance with a first embodiment of the present invention. The lighter 1 comprises a fuel reservoir 2 in the form a tubular member closed at its one end. The inner space of the fuel reservoir 2 is filled with fibers (filler) 3 and an upper lid 4 is fixedly mounted on the upper end of the fuel reservoir 2. Thus a fuel storage portion 5 containing therein fuel liquid is formed so that fuel liquid cannot be refilled.

For example, the fuel reservoir 2 is a molded product of polypropylene and has an inner volume of 5 $cm^3$. The fibers 3 are polypropylene fibers 6 deniers in thickness and pressed into the fuel reservoir 2 in a density of 0.1 $g/cm^3$. The fibers 3 are impregnated with 4 g of fuel liquid which is a mixture of 95 wt % of ethyl alcohol and 5 wt % of n-hexane.

A wick 6 is held by a wick holder 7 (support portion) to extend vertically into the fuel reservoir 2 through the upper lid 4. The wick 6 comprising a burning portion 61 and a wicking portion 62 which are formed of different materials and are connected to each other by the wick holder 7 with the lower end portion of the burning portion 61 in contact with the upper end portion of the wicking portion 62. The wick holder 7 is in the form of a cylindrical member of metal.

The lower end portion of the wicking portion 62 of the wick 6 is in contact with the fibers 3 in the fuel reservoir 2 and draws up the fuel liquid impregnated in the fibers 3 by capillarity. When the portion of the burning portion 61 exposed above the wick holder 7 is ignited, the fuel liquid burns with flame.

The burning portion 61 of the wick 6 is formed by bundling glass fibers like a rod. For example, each of the glass fibers is 6 $\mu$m in thickness, and the glass fibers are bundled into a rod which is 4 mmϕ in thickness, 10 mm in length and 150 $mg/cm^3$ in fiber density. The burning portion 61 projects upward by 5 mm from the upper end of the wick holder 7. The exposed portion of the burning portion 61 of wick 6 projecting upward from the holder 7 is 12.6 $mm^2$ in cross-sectional area and 75.4 $mm^2$ in surface area.

The wicking portion 62 of the wick 6 is formed by bundling and bonding acrylic fibers and is shaped like a rod having an enlarged head portion 62*a*. The wick 6 is formed by inserting the enlarged head portion 62*a* into the wick holder 7 into contact with the lower end portion of the burning portion 61, caulking the lower end portion of the holder 7 in this state, and connecting the burning portion 61 and the wicking portion 62 into an integrated wick 6.

For example, the wicking portion 62 is 3.4 mm in the outer diameter of the enlarged head portion 62*a*, 3 mm in length of the same, 3.0 mm in outer diameter of the leg portion and 37 mm in length of the same. The thickness of the acrylic fibers forming the wicking portion are 3 deniers, and the porosity of the wicking portion 62 is 60%.

A screw thread is formed on the outer peripheral surface of the wick holder 7, and the wick holder 7 is screwed into a threaded hole formed in the upper lid 4 with a seal ring 8 seated on the bottom of the threaded hole.

An igniting mechanism 10 is mounted on the upper lid 4 to be opposed to the upper end portion of the burning portion 61 of the wick 6. The igniting mechanism 10 comprises a bracket 11 fixed to the upper lid 4, a flint 12 which is mounted in the bracket 11 to be movable up and down, and a wheel file 13 mounted on the top of the bracket 11. The flint 12 is pressed against the surface of the wheel file 13 under the force of a spring 14 and when the wheel file 13 is rotated, spark is generated toward the wick 6.

A cap 16 for enclosing the burning portion 61 of the wick 6 and the exposed portion of the wick holder 7 is pivoted on an upper end of the fuel reservoir 2 above the upper lid 4 by a pin 17 to be rotatable about the pin 17 between an opening position and a closing position where it encloses the burning portion 61 of the wick 6 and the exposed portion of the wick holder 7 to prevent volatilization of the fuel liquid. The cap 16 is provided with an inner cap 16*a* which is fitted on the wick holder 7 and tightly encloses the wick 6. An O-ring 19 is fitted on the wick holder 7 and is engaged with the inner surface of the inner cap 16*a* to more tightly enclose the wick 6. A face plate 18 is positioned over the upper surface of the upper lid 4.

A vent hole 20 extends through the upper lid 4 along the inner surface of the wick holder 7 to communicate the inner space of the fuel reservoir 2 with the atmosphere. The vent hole 20 opens to the atmosphere in a position inside the space enclosed by the inner cap 16*a* of the cap 16. The diameter of the vent hole 20 is substantially 1.0 mmϕ.

In the lighter 1 of this embodiment, the burning portion 61 of the wick 6 was ignited and kept burning for 2 minutes. The flame length was 28 mm just after ignition, was gradually increased to 45 mm about 30 seconds after ignition, and was held at 45 mm thereafter. Thus, it was proved that the lighter 1 of this embodiment could provide an optimal burning state.

Second Embodiment

Figure 2:
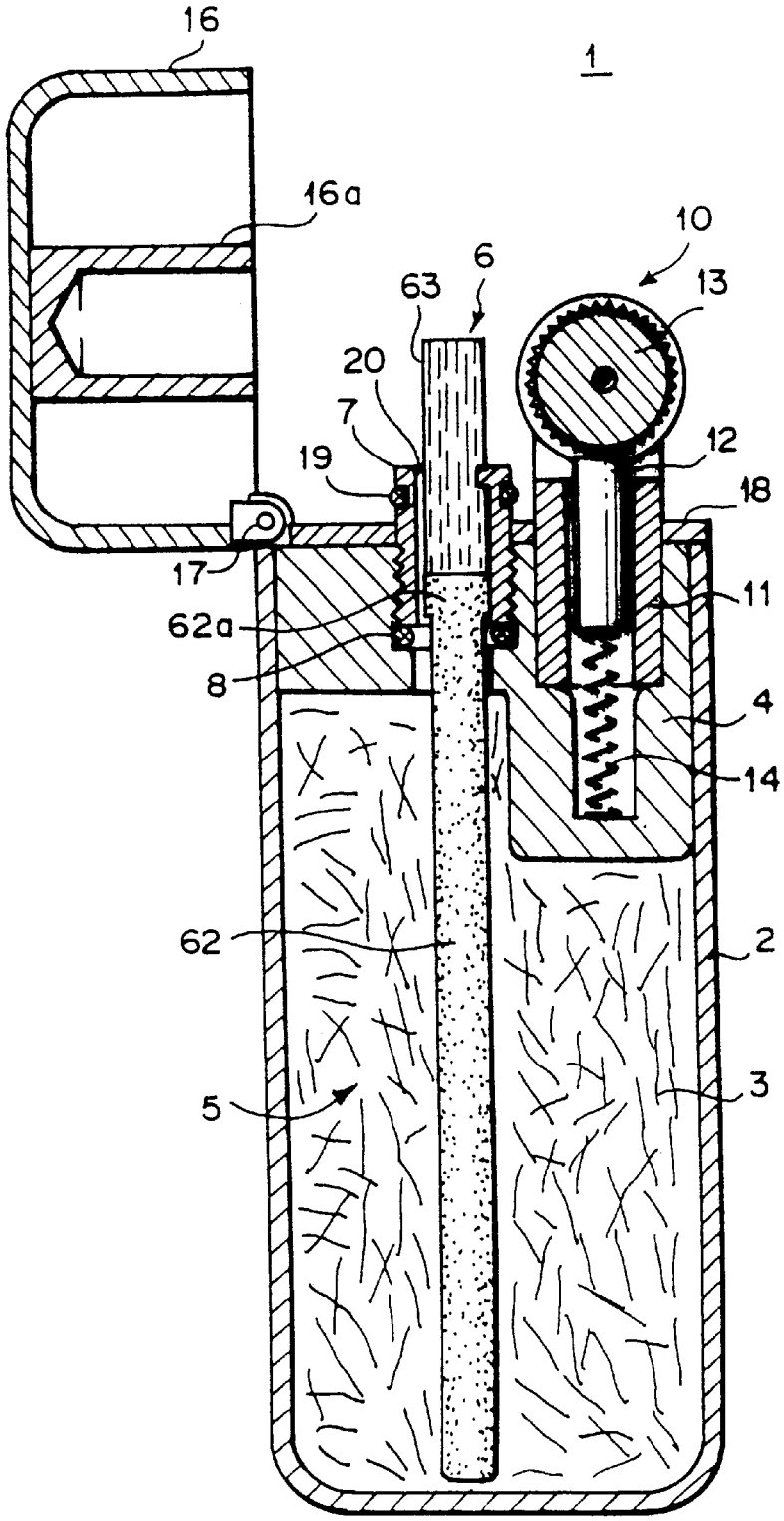
FIG. 2 is a schematic cross-sectional view of a cigarette lighter in accordance with a second embodiment of the present invention.

A cigarette lighter 1 in accordance a second embodiment of the present invention is shown in FIG. 2 and differs from that of the first embodiment only in the structure of the wick 6 as can be seen from FIG. 2. The wick 6 in the second embodiment is provided with a burning portion 63 formed of ceramic fibers in place of glass fibers.

The burning portion 63 is formed by adding a fine amount of organic binder to ceramic fibers which are of ceramic materials containing therein alumina and silica as major components and are 2.8 $\mu$mϕ in thickness, forming the mixture of the ceramic fibers and the binder into a plate about 3 mm thick, and cutting the plate into pieces which are 4 mm in width and 10 mm in length. The packing density of the fibers of this burning portion 63 is 200 $mg/cm^3$. The burning portion 63 projects upward by 5 mm from the upper end of the wick holder 7. The exposed portion of the burning portion 63 of wick 6 projecting upward from the holder 7 is 12.6 $mm^2$ in cross-sectional area and 82 $mm^2$ in surface area.

The elements other than the burning portion of the wick 6 are same as those in the first embodiment and the elements analogous to those shown in FIG. 1 are given the same reference numerals and will not be described here.

In the lighter 1 of this embodiment, the burning portion 61 of the wick 6 was ignited and kept burning for 2 minutes. The flame length was 30 mm just after ignition, was gradually increased to 50 mm about 30 seconds after ignition, and was held at 45 mm thereafter. Thus, it was proved that also the lighter 1 of this embodiment could provide an optimal burning state.

The ignitor of the present invention, including those of the first and second embodiments, basically comprises a fuel reservoir for containing fuel alcohol the main component of which is alcohol, a wick for drawing up fuel alcohol in the fuel reservoir by capillarity from one end portion inserted into the reservoir to the other end portion and burning the fuel alcohol at the other end portion and a support (wick holder) which holds the wick with said the other end portion projecting from the support, and is characterized in that the outer diameter of the burning end portion (said the other end portion) of the wick is in the range of 2 mm to 5 mm, the length by which the burning end portion of the wick projects from the support is in the range of 3.0 mm to 7.0 mm, and the surface area of the burning end portion of the wick projecting from the support is in the range of 30 $mm^2$ to 170 $mm^2$ (30 $mm^2$ to 100 $mm^2$ in the case of a cigarette lighter) when the wick is of glass fibers and is in the range of 40 $mm^2$ to 170$mm^2$ (40 $mm^2$ to 100 $mm^2$ in the case of a cigarette lighter) when the wick is of ceramic fibers.

These limits are for meeting the requirements that the flame length is at least about 20 mm just after ignition, is increased to about 25 mm in 5 to 10 seconds after ignition and is held at a saturated flame length not larger than 65 mm.

Figure 3:
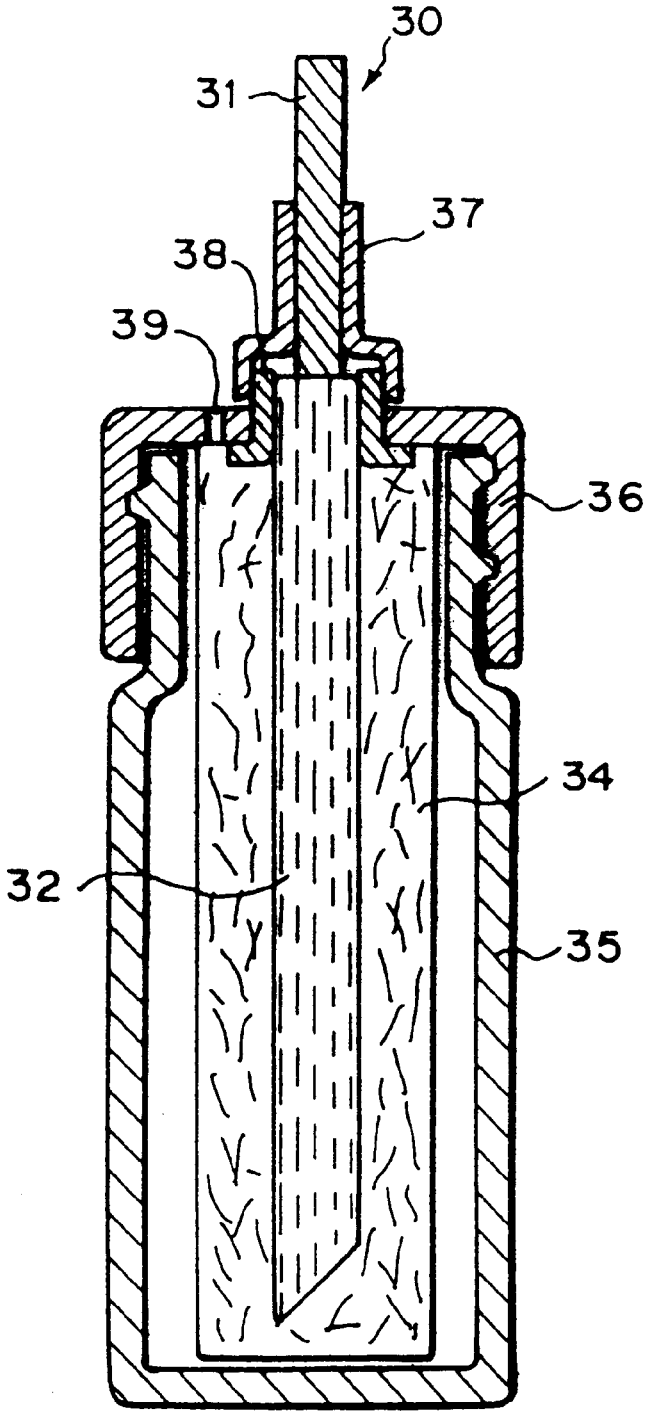
FIG. 3 is a cross-sectional view of a basic sample of the ignitor used in an experiment.

The values were determined through various experiments using a sample shown in FIG. 3. In FIG. 3, a container 35 as a fuel reservoir is filled with filler 34. The filler 34 is impregnated with fuel alcohol, and a wicking portion 32 of a wick 30 is inserted into the container 35 in contact with the filler 34. An upper lid 36 is screwed on the open top of the container 35, and a jig holder 38 which holds the upper end portion of the wicking portion 32 is fixed to the upper lid 36 at the center thereof. A wick holding jig as a wick holder which holds a burning portion 31 of the wick 30 is mounted on the jig holder 38 so that the lower end portion of the burning portion 31 is connected to the upper end portion of the wicking portion 32.

As the burning portion 31 of the wick 30, the glass fiber wick employed in the first embodiment or the ceramic fiber wick employed in the second embodiment is used. The diameter of the fibers and the porosity of the burning portion 31 are suitably selected so that fuel liquid can be replenished through the wicking portion 32 of acrylic fibers in an amount larger than that consumed by burning at the burning portion.

Though glass fiber wicks which were formed of glass fibers 6 $\mu$m thick and were 150 $mg/cm^3$ in packing density were used, the glass fiber wicks may be of somewhat different dimensions provided that fuel liquid can be replenished to the surface of the wick in an amount larger than that consumed by burning at the burning portion. Similarly though ceramic fiber wicks which were formed of ceramic fibers 2.8 $\mu$m thick and were 2000 $mg/cm^3$ in packing density were used, the ceramic fiber wicks may be of somewhat different dimensions provided that fuel liquid can be replenished to the surface of the wick in an amount larger than that consumed by burning at the burning portion. Further, though the experiments were carried out by use of particular glass fibers and ceramic fibers, results of the experiments may be applied to other materials provided that they are equivalent to the glass fibers and ceramic fibers employed in heat-resistance and wicking and dispersing power.

Glass fiber burning portions and ceramic fiber burning portions which were different in dimensions (the outer diameter and the length) were prepared and wick holding jigs 37 which corresponded to the respective burning portions were prepared. Then burning test was effected while changing the length by which the burning portion projected from the jig 37 and the surface area of the exposed portion. The results are shown in FIGS. 4 to 9. Fuel liquid employed in the first embodiment was employed.

Figure 4:
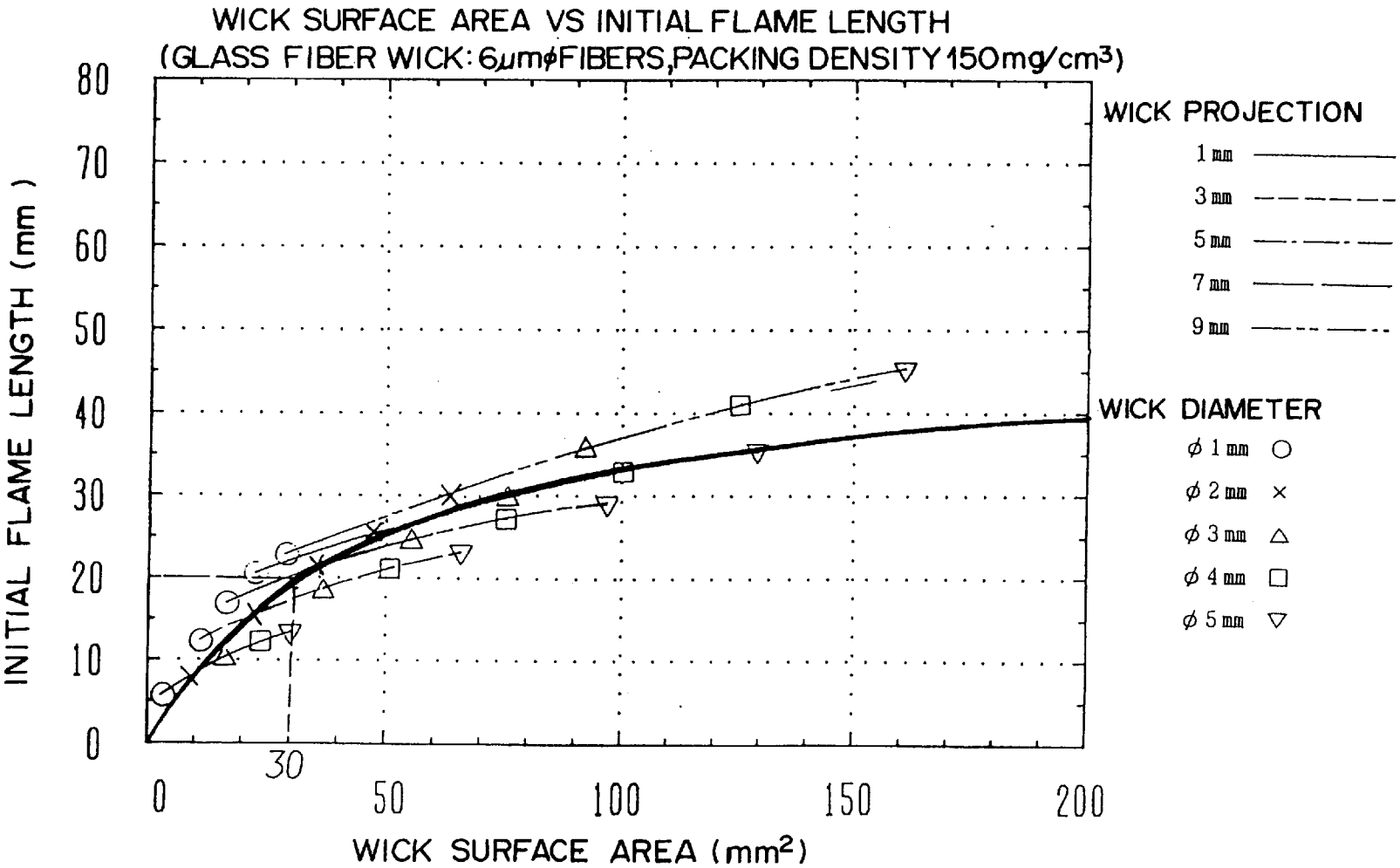
FIG. 4 is a graph showing the relation between the surface area of the exposed portion of the wick and the initial flame length for wicks of glass fibers.
Figure 5:
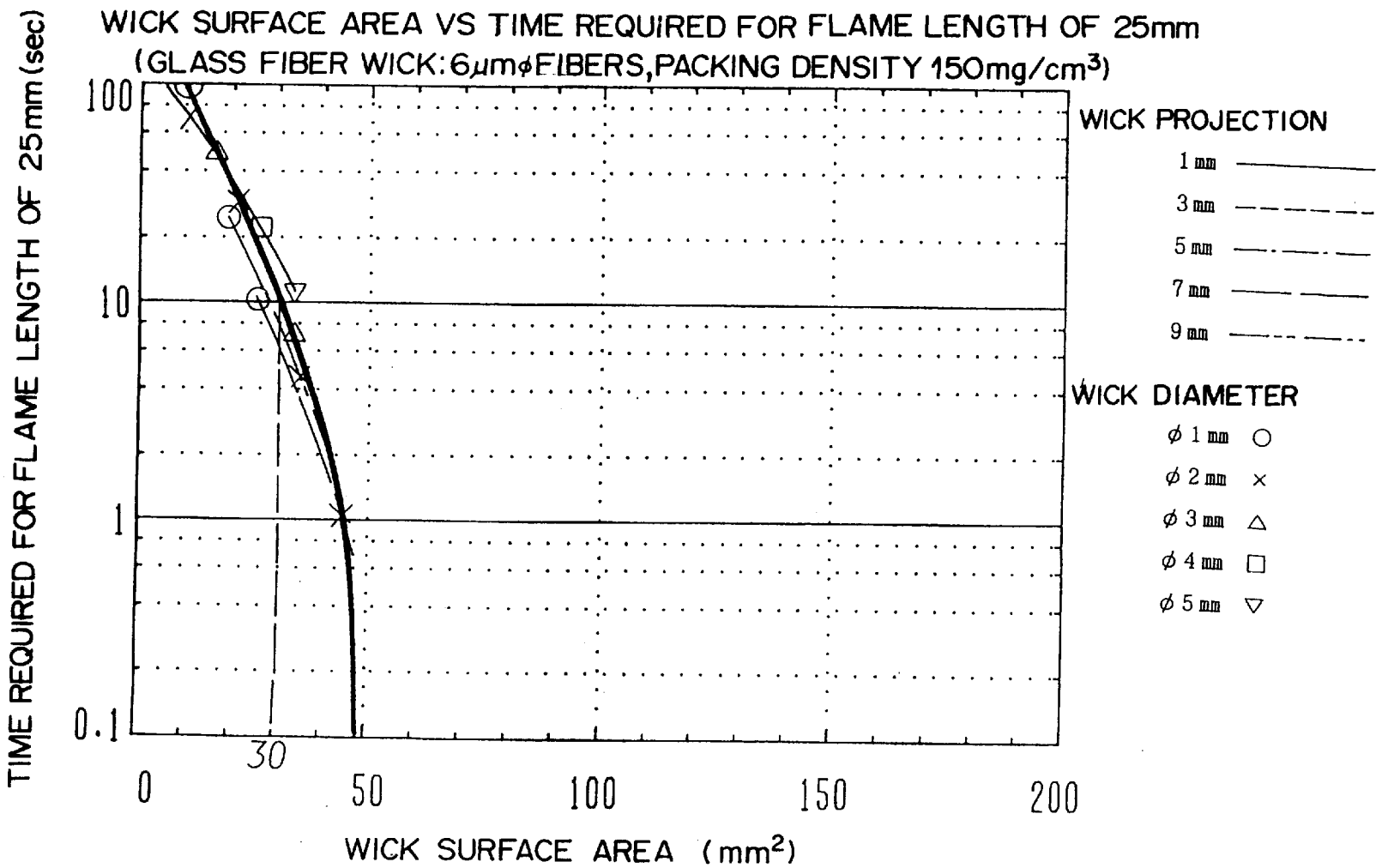
FIG. 5 is a graph showing the relation between the surface area of the exposed portion of the wick and the time required for the flame length to reach 25 mm for wicks of glass fibers.
Figure 6:
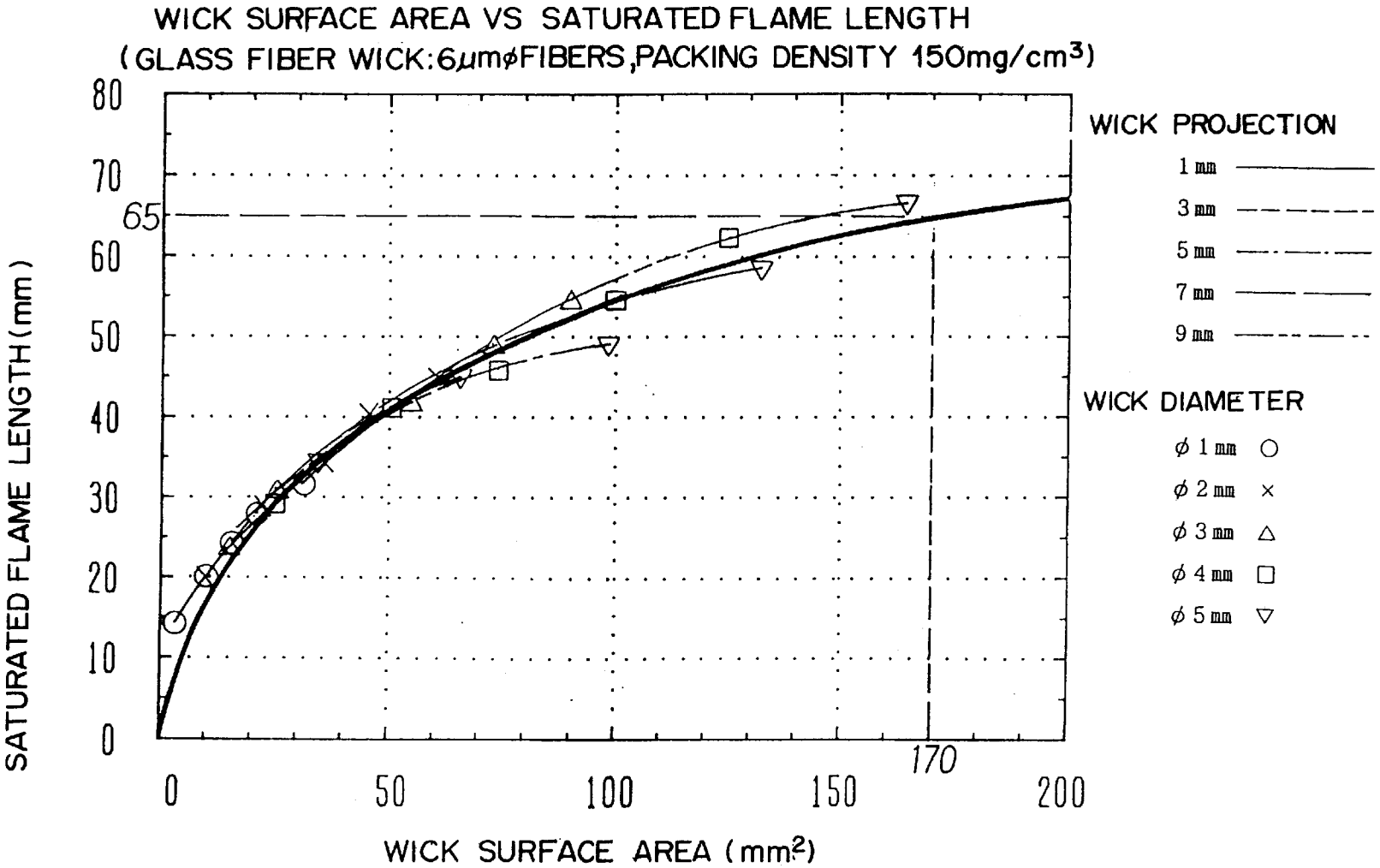
FIG. 6 is a graph showing the relation between the surface area of the exposed portion of the wick and the saturated flame length for wicks of glass fibers.

FIGS. 4 to 6 show the relations between the initial flame length and the surface area of the exposed portion of the burning portion, between the time which the flame length took to increase to 25 mm and the surface area of the exposed portion of the burning portion, and between the saturated flame length and the surface area of the exposed portion of the burning portion for outer diameters of glass fibers of 1 mmϕ, 2 mmϕ, 3 mmϕ, 4 mmϕ and 5 mmϕ and projecting lengths of 1 mm, 3 mm, 5 mm, 7 mm and 9 mm.

Figure 7:
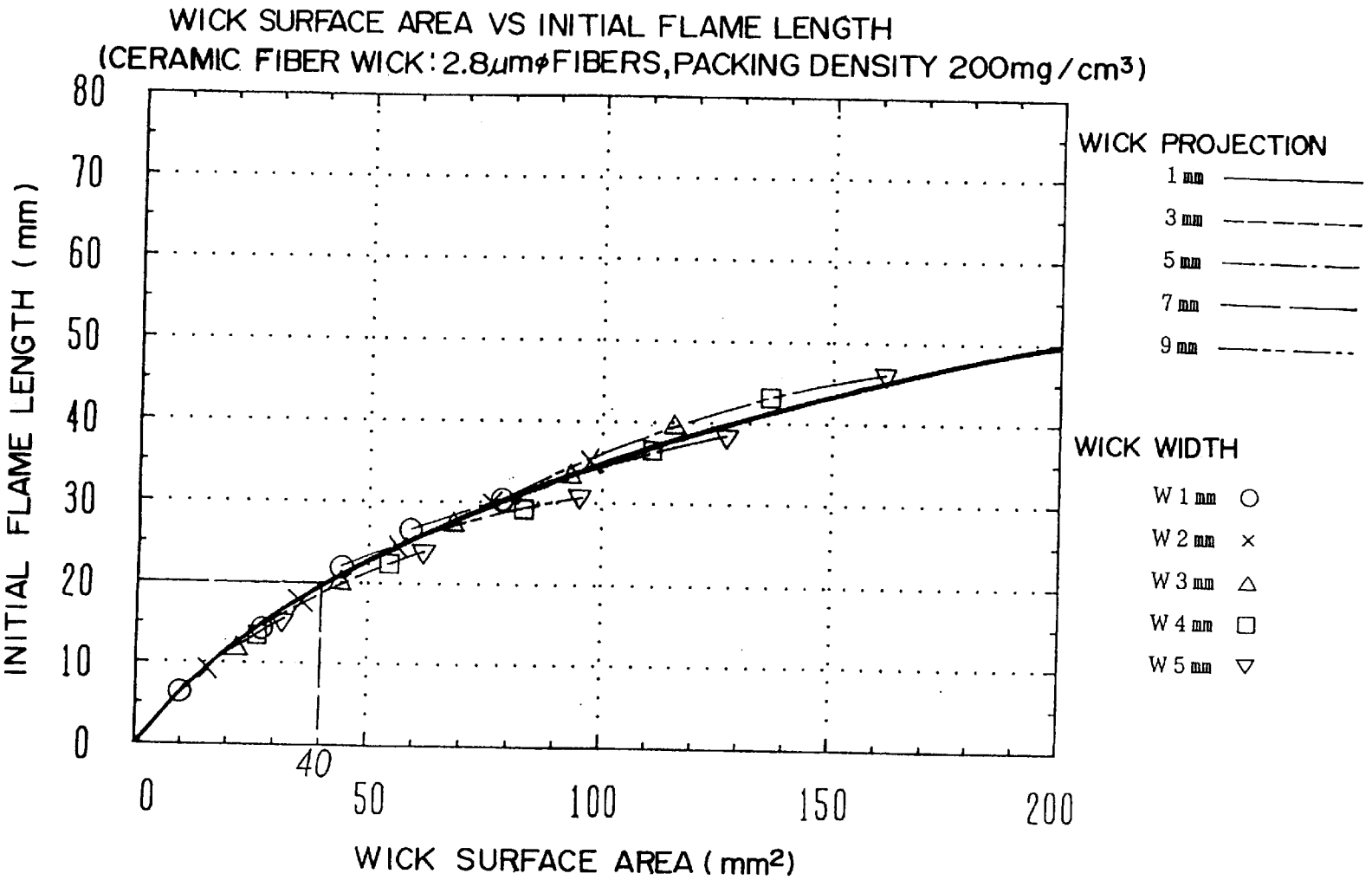
FIG. 7 is a graph showing the relation between the surface area of the exposed portion of the wick and the initial flame length for wicks of ceramic fibers.
Figure 8:
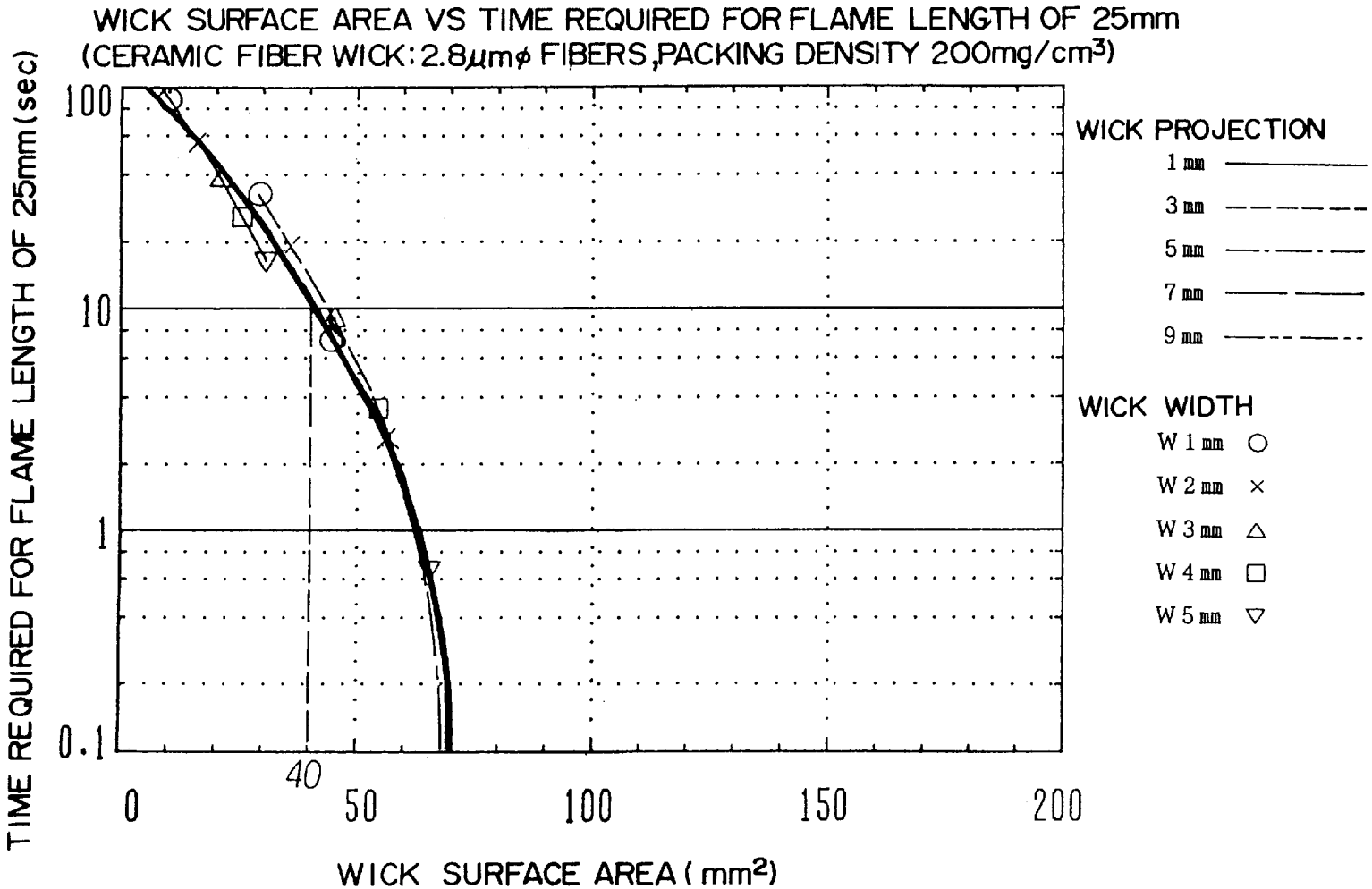
FIG. 8 is a graph showing the relation between the surface area of the exposed portion of the wick and the time required for the flame length to reach 25 mm for wicks of ceramic fibers.
Figure 9:
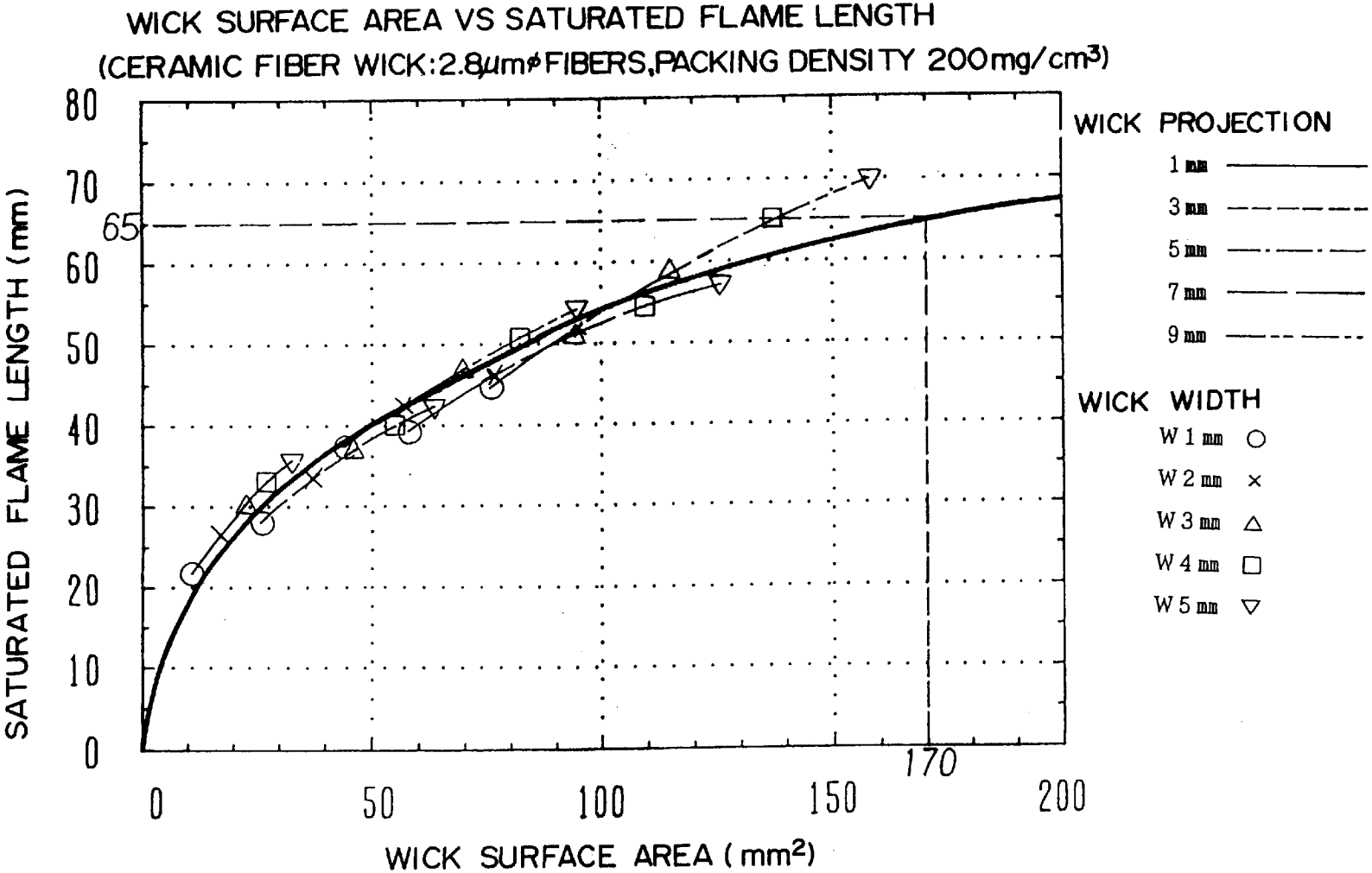
FIG. 9 is a graph showing the relation between the surface area of the exposed portion of the wick and the saturated flame length for wicks of ceramic fibers.
Figure 10:
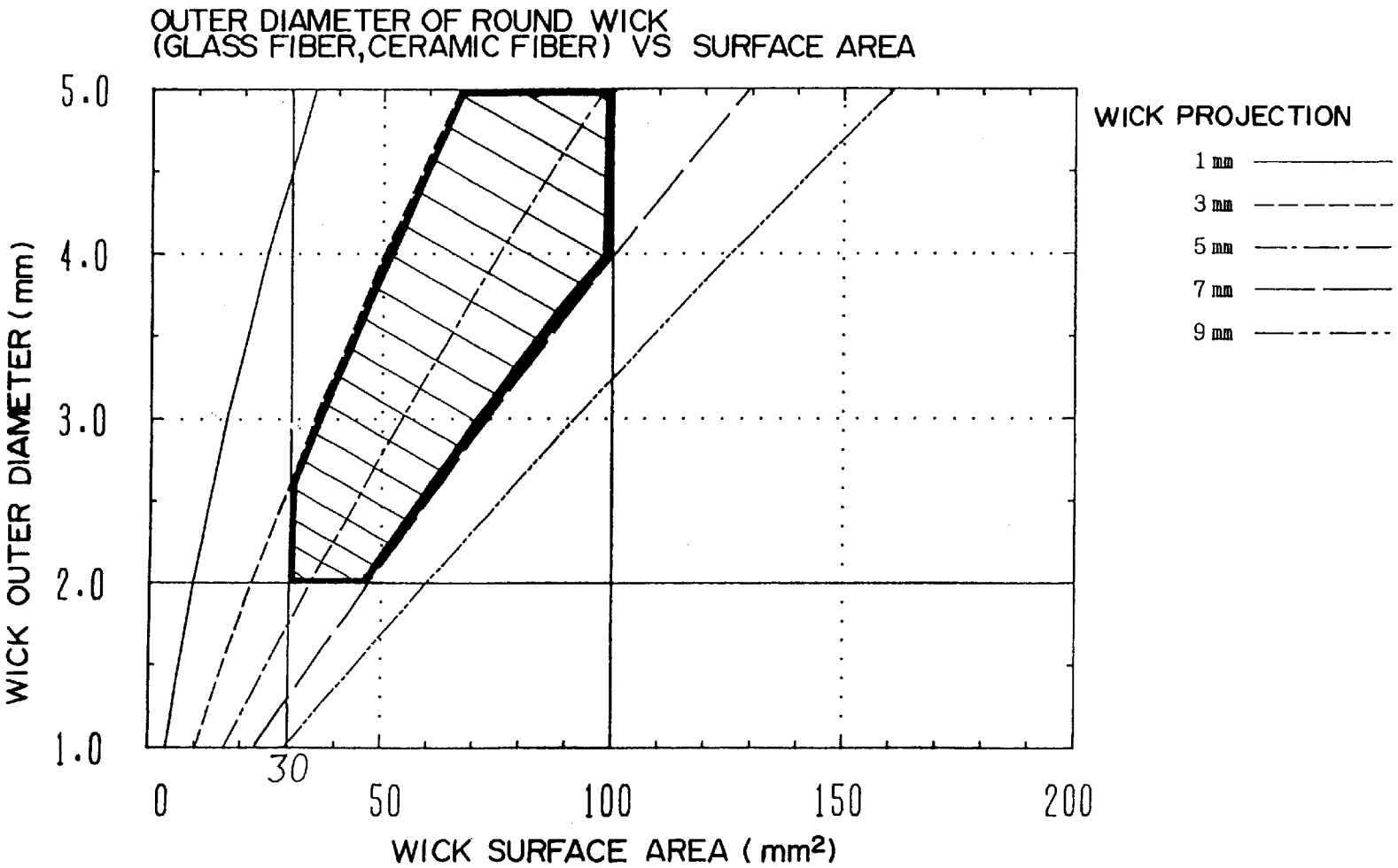
FIGS. 10 to 19 are views showing an optimal range of the relation between the surface area of the exposed portion of the wick and various dimensions of the wick in which a good burning state can be obtained for various materials of the wick and the cross-sectional shape of the same in the case where the wick is used in a cigarette lighter.
Figure 11:
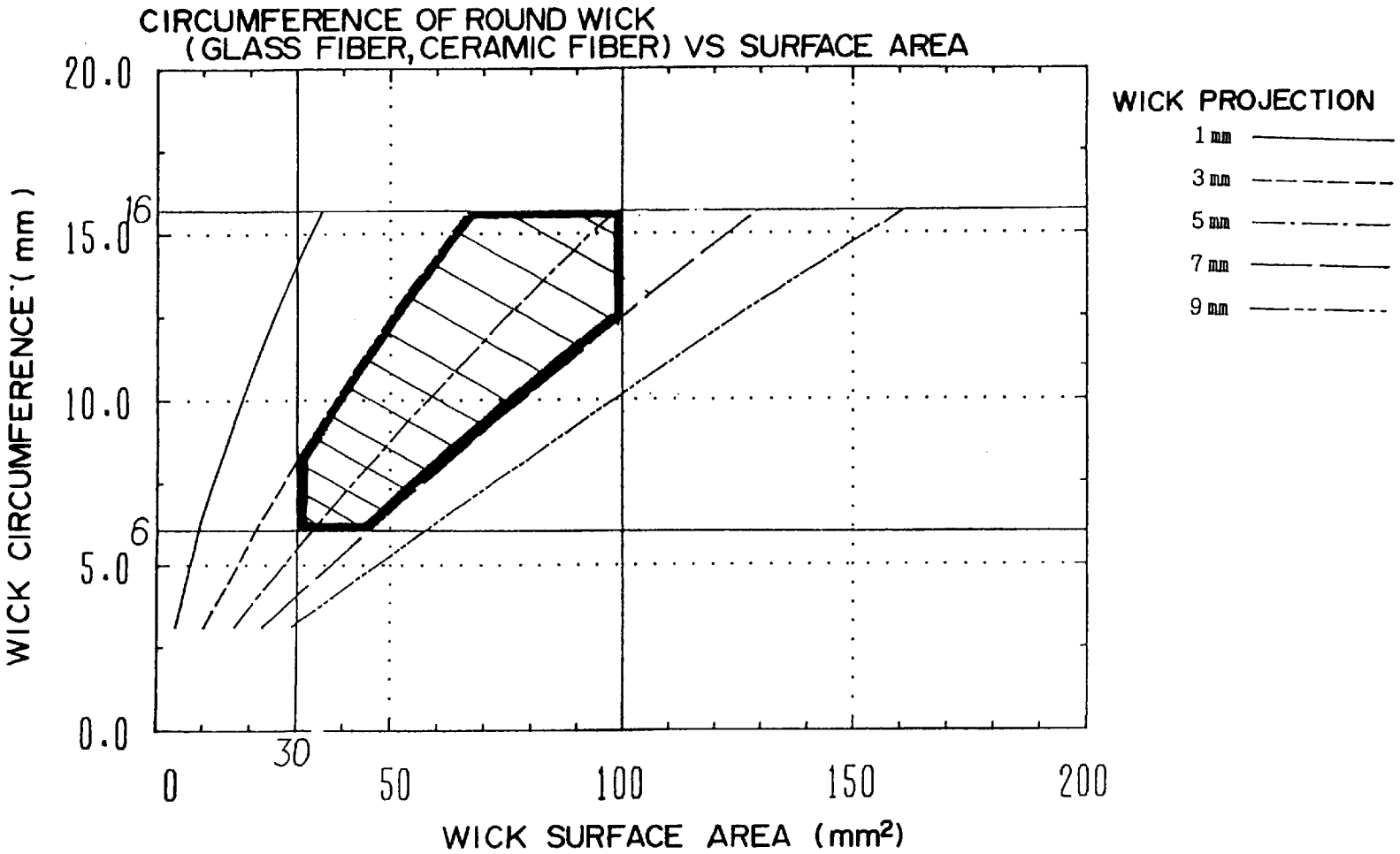
Figure 12:
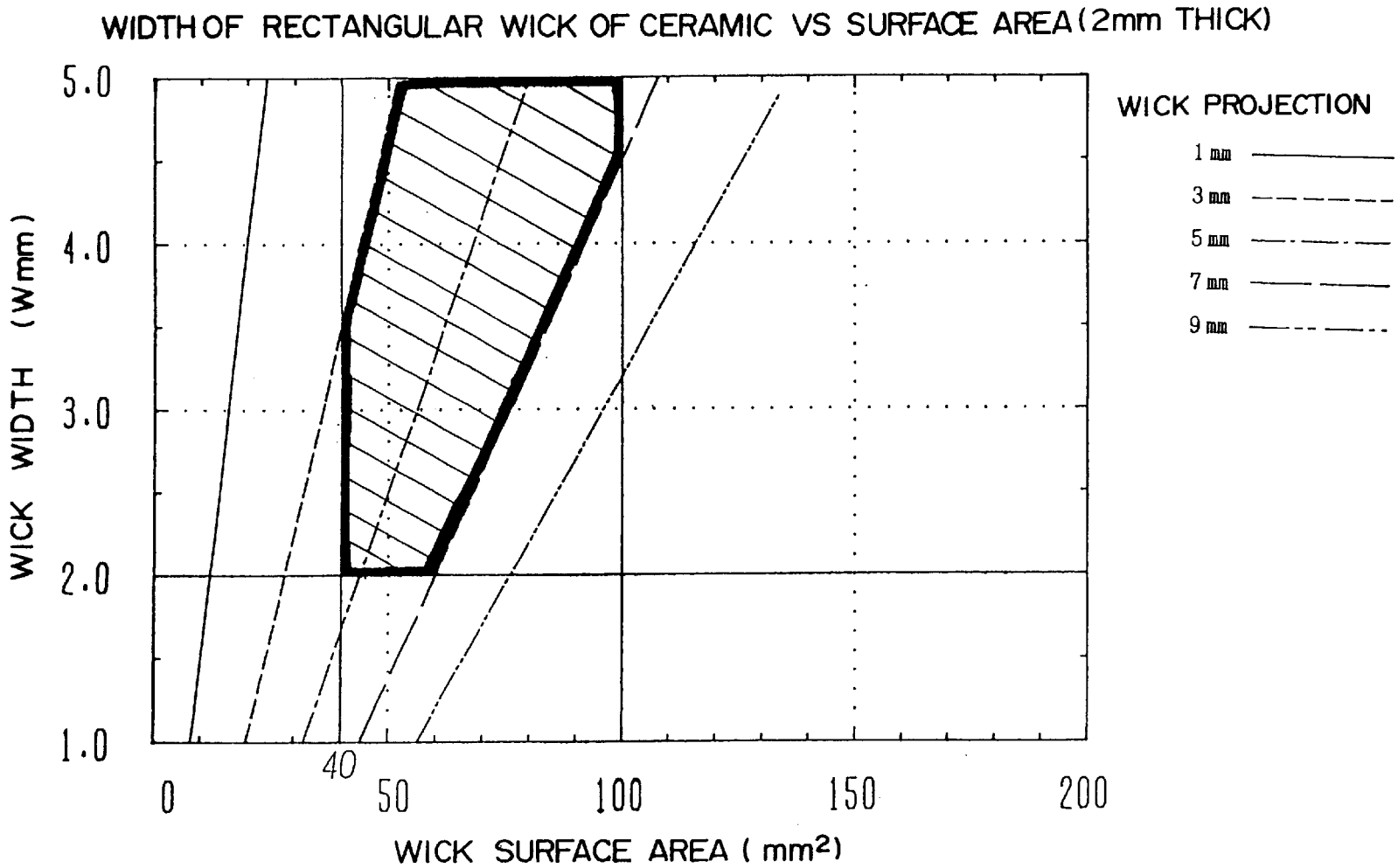
Figure 13:
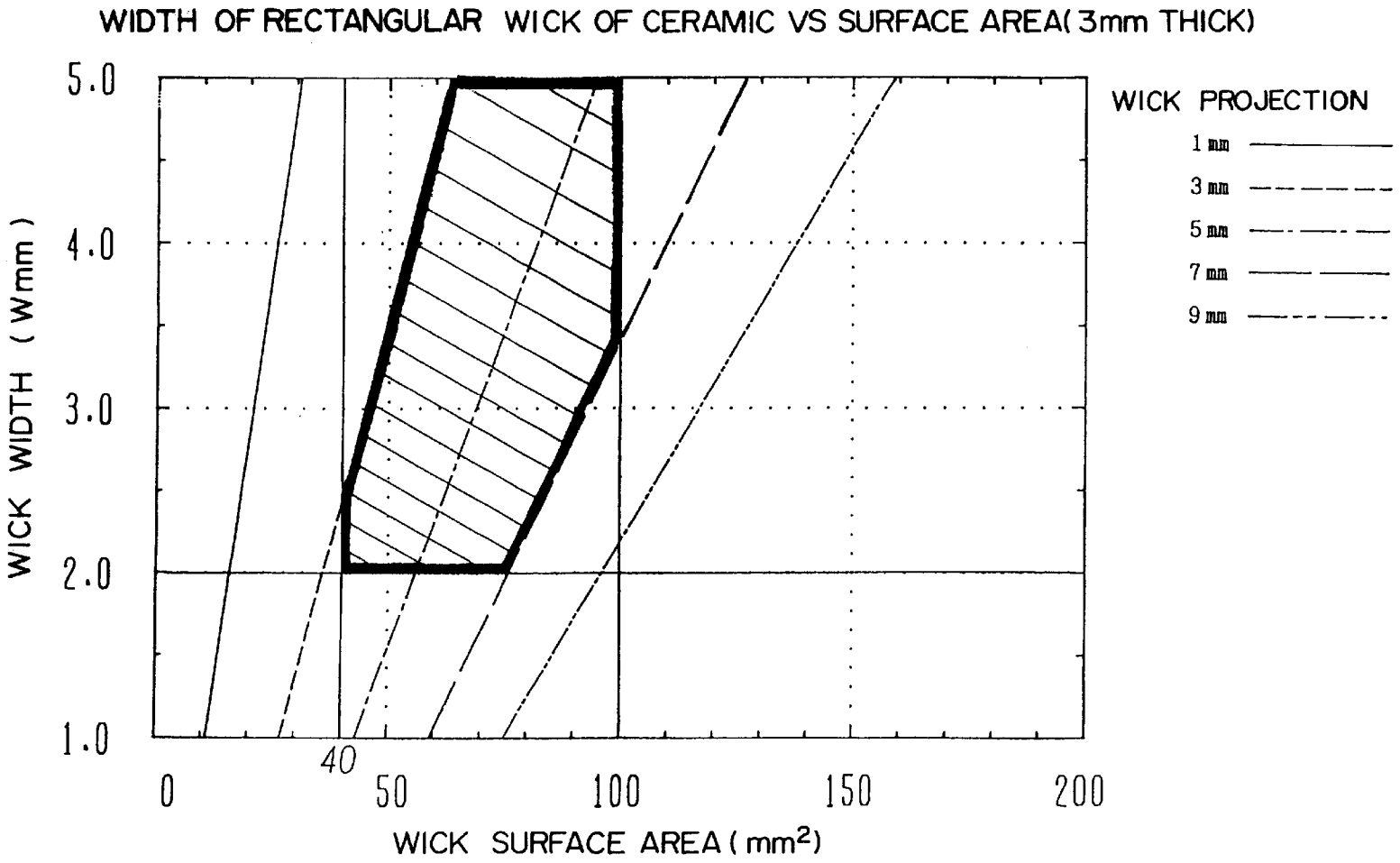
Figure 14:
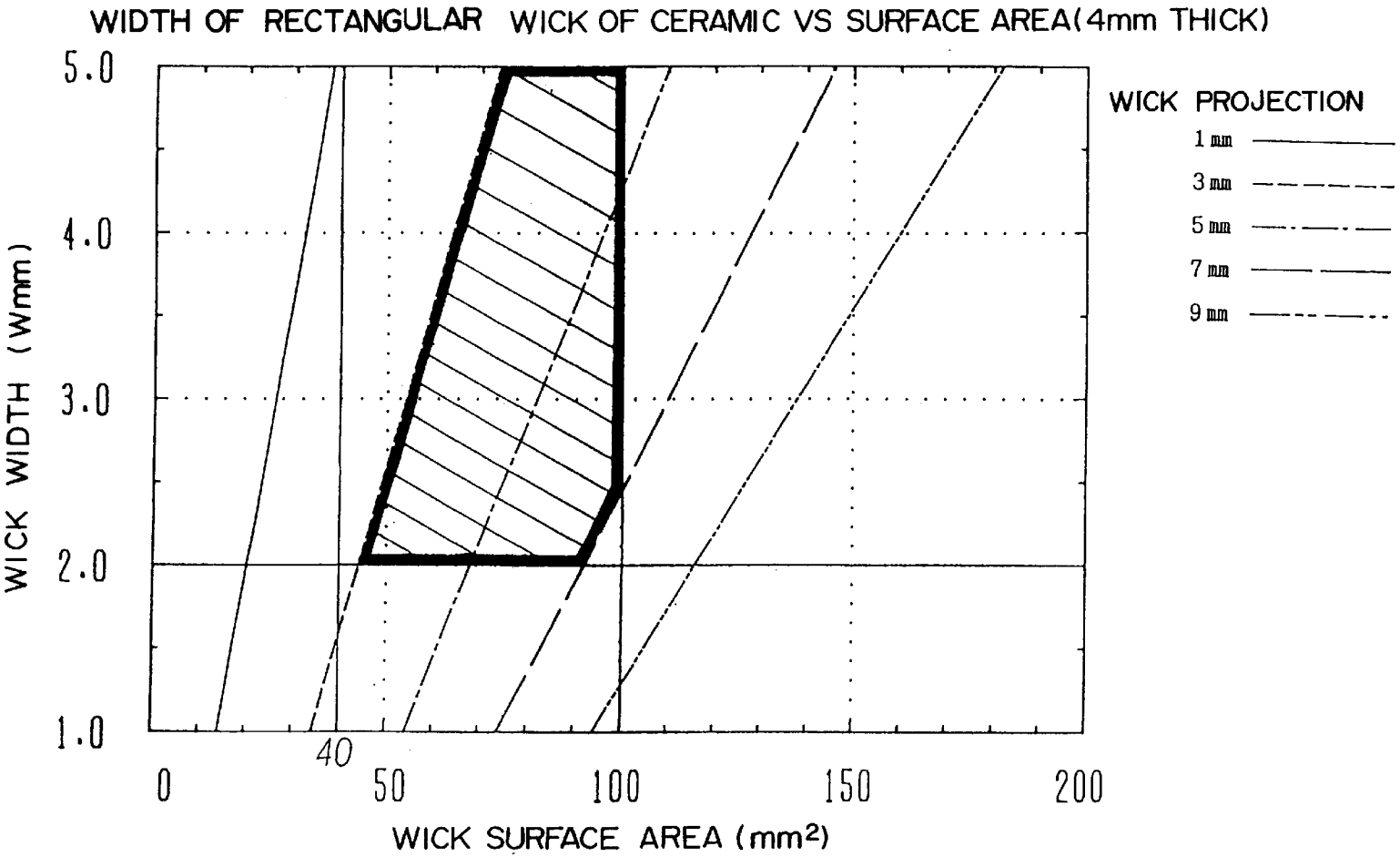
Figure 15:
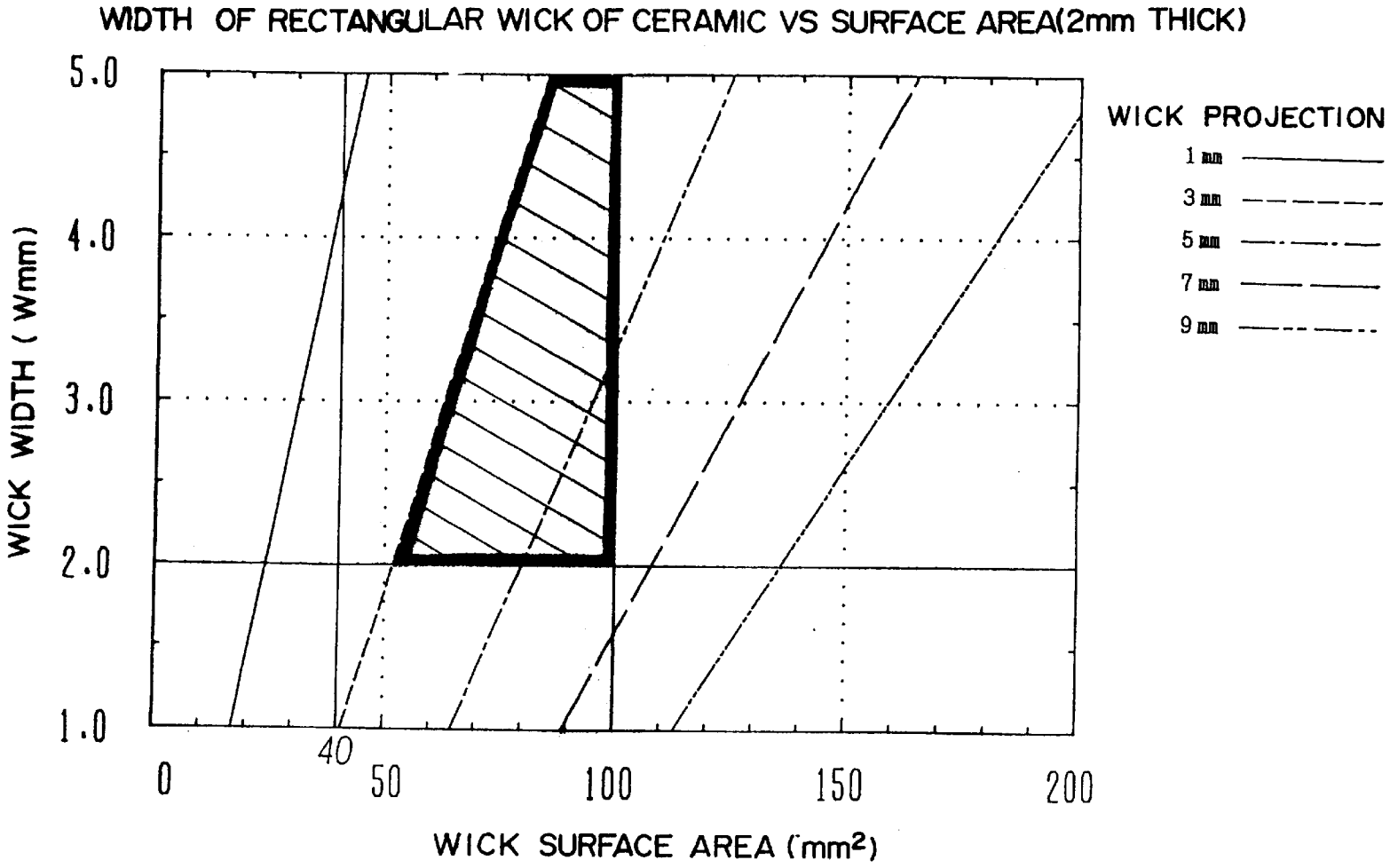
Figure 16:
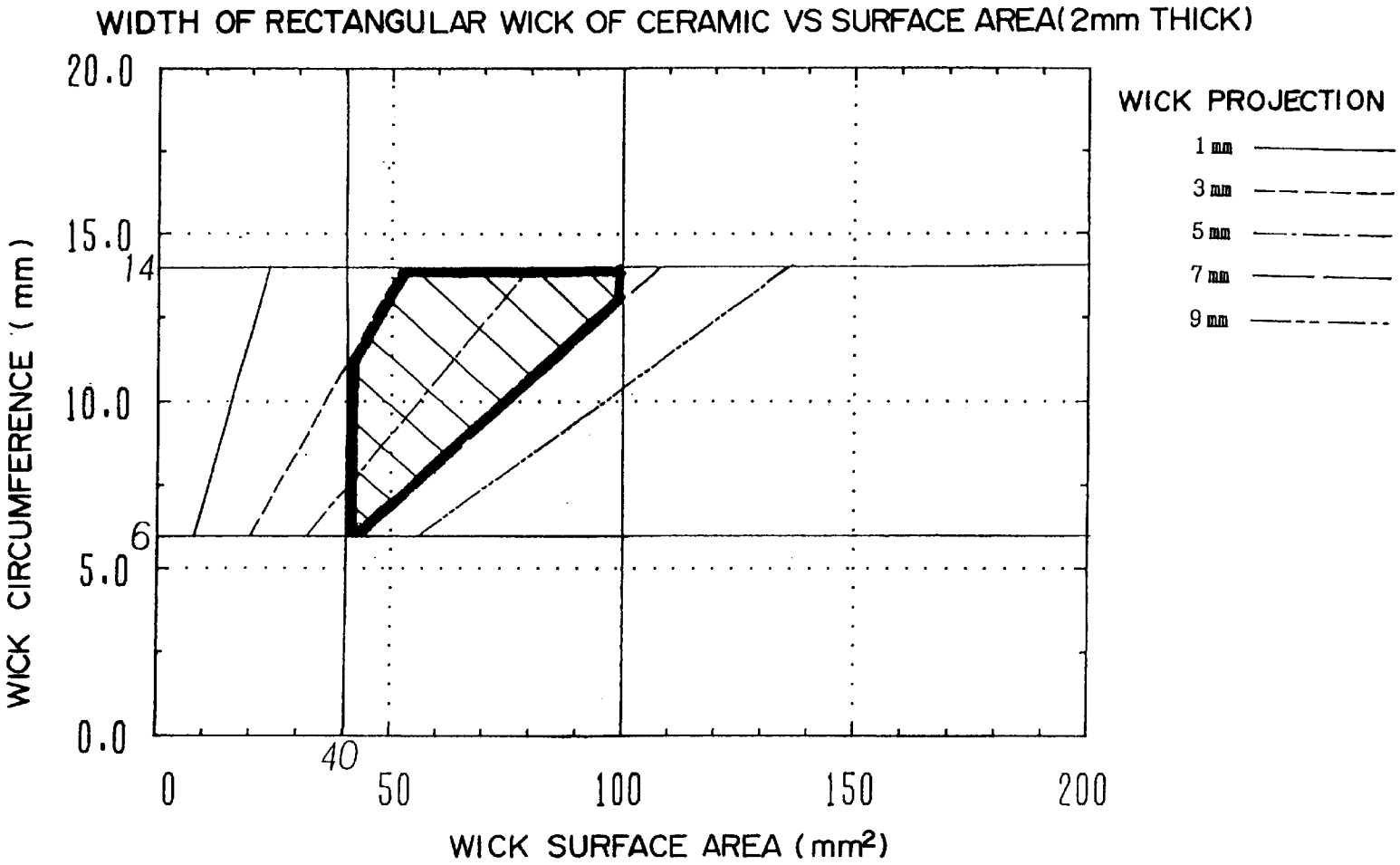
Figure 17:
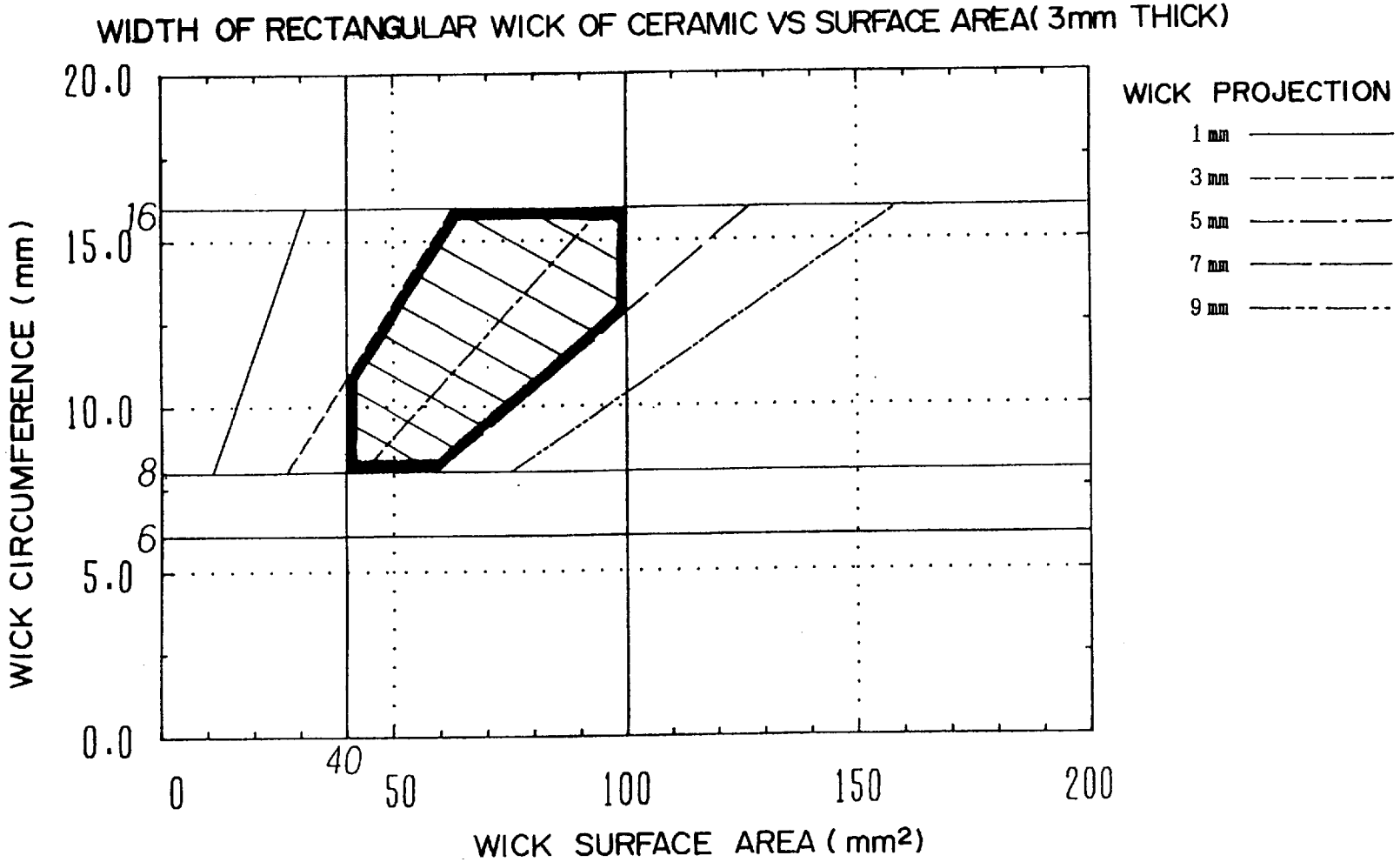
Figure 18:
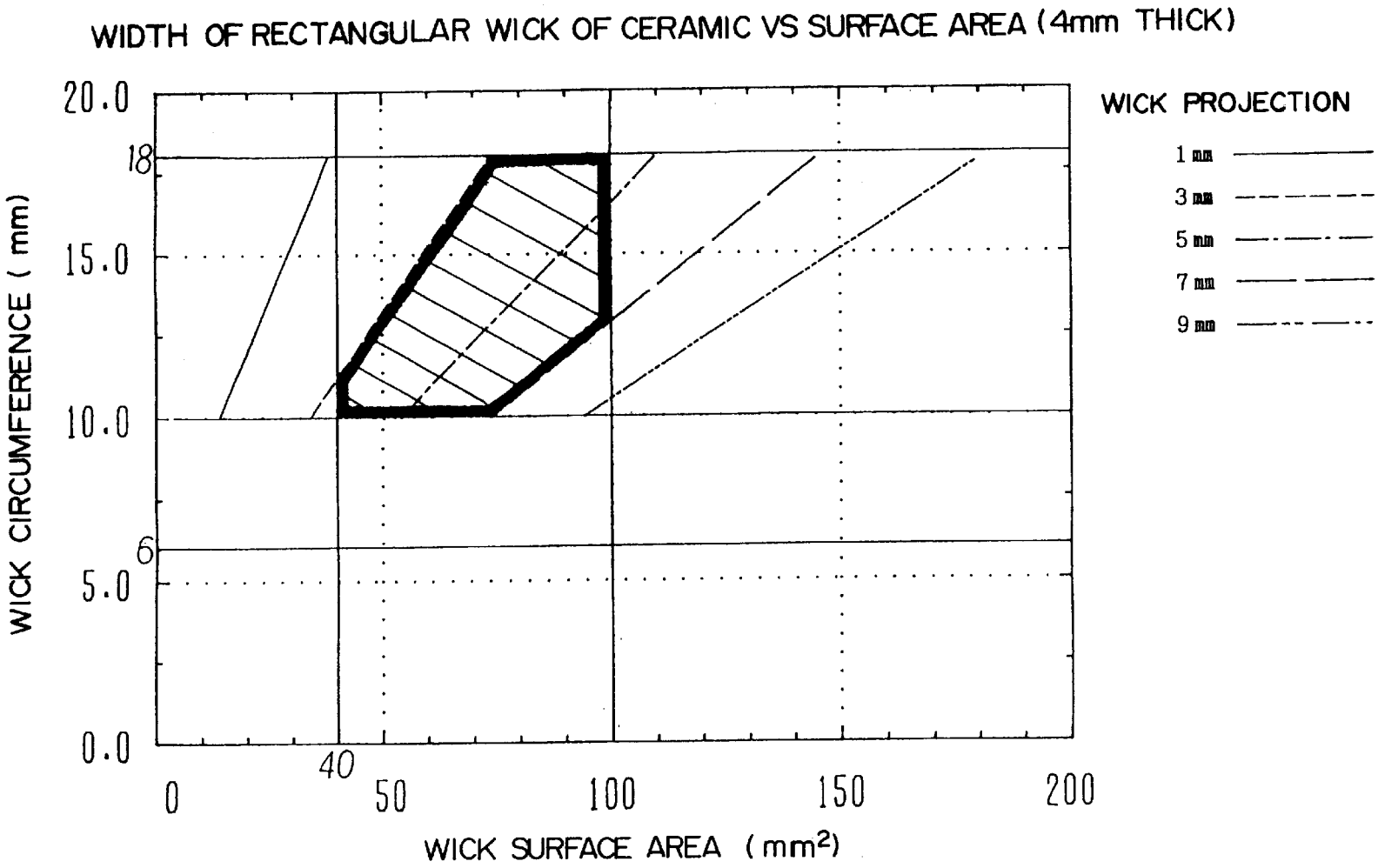
Figure 19:
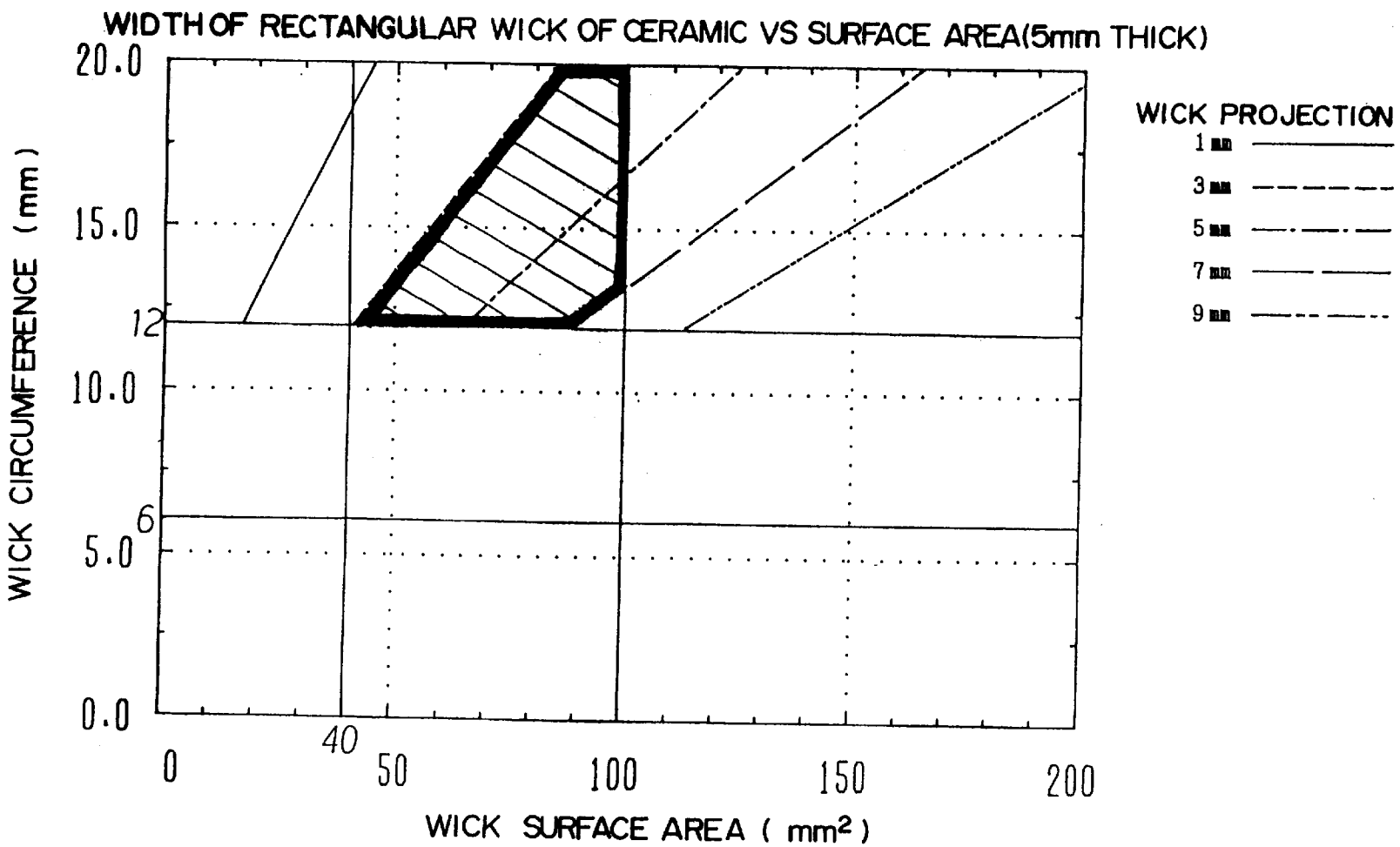

FIGS. 7 to 9 show the relations between the initial flame length and the surface area of the exposed portion of the burning portion, between the time which the flame length took to increase to 25 mm and the surface area of the exposed portion of the burning portion, and between the saturated flame length and the surface area of the exposed portion of the burning portion for widths of 3 mm thick ceramic fiber wick of 1 mm, 2 mm, 3 mm, 4 mm and 5 mm and projecting lengths of 1 mm, 3 mm, 5 mm, 7 mm and 9 mm.

The surface area of the wicks are represented by values obtained by calculating the areas of the side surfaces and the end surface on the basis of the dimensions of the exposed portion of the wicks with microscopic unevenness on the surface of the wicks ignored.

As can be seen from FIG. 4, which shows the relation between the surface area of the wick and the initial flame length for the glass fiber wick, the surface area of the burning portion should be not smaller than 30 $mm^2$ in order to obtain an initial flame length of not shorter than 20 mm. When the surface area is 100 $mm^2$, the initial flame length is about 35 mm and when the surface area is 170 $mm^2$, the initial flame length is about 40 mm. These values of initial flame lengths are suitable for the ignitor.

As can be seen from FIG. 5, which shows the relation between the time which the flame length took to increase to 25 mm and the surface area of the exposed portion of the burning portion in the case of glass fiber wicks, the surface area of the burning portion should be not smaller than 30 $mm^2$ in order to keep the time which the flame length takes to increase to 25 mm not longer than about 10 seconds.

As can be seen from FIG. 6, which shows the relation between the saturated flame length and the surface area of the exposed portion of the burning portion in the case of glass fiber wicks, the saturated flame length is 65 mm when the surface area is 170 $mm^2$ and the surface area may be not larger than 170 $mm^2$ in order to keep the saturated flame length not longer than 60 mm to 70 mm. When the ignitor is a cigarette lighter, where the saturated flame length is to be not longer than 50 mm to 60 mm, the surface area should be not larger than 100 $mm^2$.

Further, as can be seen from FIG. 7, which shows the relation between the surface area of the wick and the initial flame length for the ceramic fiber wick, the surface area of the burning portion should be not smaller than 40 $mm^2$ in order to obtain an initial flame length of not shorter than 20 mm. When the surface area is 170 $mm^2$, the initial flame length is about 45 mm, which is considered to be an upper acceptable limit of the initial flame length for the ignitor. When the surface area is 100 $mm^2$, the initial flame length is about 35 mm, which is considered to be an upper acceptable limit of the initial flame length for the cigarette lighter.

As can be seen from FIG. 8, which shows the relation between the time which the flame length took to increase to 25 mm and the surface area of the exposed portion of the burning portion in the case of ceramic fiber wicks, the surface area of the burning portion should be not smaller than 40 $mm^2$ in order to keep the time which the flame length takes to increase to 25 mm not longer than about 10 seconds.

As can be seen from FIG. 9, which shows the relation between the saturated flame length and the surface area of the exposed portion of the burning portion in the case of glass fiber wicks, the saturated flame length is 65 mm when the surface area is 170 $mm^2$ and the surface area may be not larger than 170 $mm^2$ in order to keep the saturated flame length not longer than 60 mm to 70 mm. When the ignitor is a cigarette lighter, where the saturated flame length is to be not longer than 50 mm to 60 mm, the surface area should be not larger than 100 $mm^2$.

As can be understood from the aforesaid results of the experiments, the structure of the burning portion of the alcohol-fueled ignitor can be made optimal to obtain a good burning state by limiting the surface area and the shape of the burning portion of the wick to the range described above, whereby design of the burning portion is facilitated.

FIGS. 10 to 19 show optimal ranges of the surface area of the wick for cigarette lighters in relation to the outer dimensions of the wick for the cases where the wick is of a bundle of glass fibers which is circular in cross-section, the wick is of ceramic fibers formed into a bar which is circular in cross-section and the wick is of ceramic fibers formed into a bar which is rectangular in cross-section. The optimal ranges are determined taking into account the size range, the mechanical strength and the mechanical applicability of the wick acceptable to a cigarette lighter in addition to the range of the dimensions of the wick which governs the performance of the lighter on the basis of the result of the aforesaid experiments. Practically, the space for mounting the wick and the amount of projection of the wick from the support must be determined taking into account the shape of the lighter and the like, and the overall shape of the wick can be determined according to the surface area necessary to obtain desired burning properties. Thus the overall shape and dimensions of the wick can be easily and efficiently determined.

What is claimed is:

1. A structure of a burning portion of a wick for an alcohol-fueled ignitor provided with a wick for drawing up fuel alcohol in a fuel reservoir by capillarity from a reservoir portion thereof to the burning portion and burning the fuel alcohol at the burning portion comprising:

a wick burning portion to burn alcohol received by capillarity from a reservoir portion disposed in an alcohol fuel reservoir formed of glass or ceramic fibers having a diameter in a rage from about 2.8 $\mu$m to about 6 $\mu$m bundled together in a rod shape at a density in range from about 150 mg./$cm^3$ to about 200 mg/$cm^3$; and a supply of fuel alcohol in the burning portion of the wick;

the burning portion of the wick being maintained in a rod shape and having an exposed surface area in a range from about 30 mm to about 170 $mm^2$ to provide an initial flame length following ignition of at least about 20 mm and a stabilized flame length in a range from about 45 mm to about 70 mm.

2. A structure of a burning portion as defined in claim 1 in which the ignitor is a cigarette lighter, and the burning portion of the wick has an exposed surface area in a range from about 30 $mm^2$ to about 100 $mm^2$.

3. A structure of a burning portion as defined in claim 1 in which the ignitor is a cigarette lighter, and the burning portion of the wick has an exposed surface area in a range from about 40 $mm^2$ to about 100 $mm^2$.

4. A structure of a burning portion as defined in claim 1 in which the circumference of the burning portion of the wick is in the range from about 6 mm to about 20 mm.

5. A structure of a burning portion as defined in claim 1 in which the outer diameter of the burning portion of the wick is in the range from about 2 mm to about 5 mm.

6. A structure of a burning portion as defined in claim 1 in which the length by which the burning portion of the wick projects from a support is in the range from about 3.0 mm to about 7.0 mm.

7. A structure of a burning portion of a wick for an alcohol-fueled ignitor provided with a wick for drawing up fuel alcohol in a fuel reservoir by capillarity from a reservoir portion thereof to the burning portion and burning the fuel alcohol at the burning portion wherein the improvement comprises that comprising:

said the other end portion of the a wick having a burning portion comprising glass or ceramic fibers having a diameter in the range from about 2.8 $\mu$m to about 6 $\mu$m bundled together at a density in a range from about 150 mg/$cm^3$ to about 200 mg/$em^3$ in a rod shape at which the fuel alcohol is burnt; and a supply of fuel alcohol in the burning portion of the wick;

the burning portion of the wick being maintained in a rod shape and having an exposed surface area which is selected so that the flame length is not shorter than about 20 mm just after ignitions is increased to a length in a range from 45 mm to about 70 mm within about two minutes after ignition and is held at a saturated flame length not larger than about 70 mm.

* * * * *

UNITED STATES PATENT AND TRADEMARK OFFICE

CERTIFICATE OF CORRECTION

PATENT NO. : 6,227,844 B1
DATED : May 8, 2001
INVENTOR(S) : Mifune et al.

It is certified that error appears in the above-identified patent and that said Letters Patent is hereby corrected as shown below:

Title page,
Item [54], Title, COMBUSTOR STRUCTURE FOR IGNITERS" should read -- STRUCTURE OF BURNING PORTION OF IGNITOR --.
Item [56], References Cited, insert -- FOREIGN PATENT DOCUMENTS, 1-239304 9/1989 (JP) Japan --.

Column 2,
Line 8, "wicks" should read -- wick --.

Column 5,
Line 2, "form a" should read -- form of a --.
Line 9, "6" should read -- 6 --.
Line 49, "3" should read -- 3 --.

Column 7,
Line 34, "were" should be deleted.
Line 40, "were" should be deleted.

Column 9,
Line 42, "rage" should read -- range --.
Line 44, "range" should read -- a range --; and "mg./cm$^3$" should read -- mg/cm$^3$ --.

Column 10,
Line 3, "30mm" should read -- 30 mm$^2$ --.
Line 30, "comprises that comprising" should read -- comprising --.
Line 35, "mg/em$^3$" should read -- mg/cm$^3$ --.
Line 41, "ignitions" should read -- ignition --.

Signed and Sealed this

Twenty-fifth Day of June, 2002

*Attest:*

*Attesting Officer*

JAMES E. ROGAN
*Director of the United States Patent and Trademark Office*